US011950622B2

(12) United States Patent
Mishra et al.

(10) Patent No.: US 11,950,622 B2
(45) Date of Patent: Apr. 9, 2024

(54) METHOD OF MAKING CAPSULE INCLUDING FILLER MATERIAL INFUSED WITH CONSUMABLE

(71) Applicant: Altria Client Services LLC, Richmond, VA (US)

(72) Inventors: Munmaya K. Mishra, Manakin Sabot, VA (US); Danielle Crawford, Richmond, VA (US); Dwight David Williams, Powhatan, VA (US); Eric Hawes, Midlothian, VA (US); Terry Bache, Richmond, VA (US); Raymond W. Lau, Glen Allen, VA (US); Shaoyong Yu, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 27 days.

(21) Appl. No.: 17/902,271

(22) Filed: Sep. 2, 2022

(65) Prior Publication Data

US 2022/0408792 A1 Dec. 29, 2022

Related U.S. Application Data

(62) Division of application No. 16/125,293, filed on Sep. 7, 2018, now Pat. No. 11,432,581.

(51) Int. Cl.

| | |
|---|---|
| ***A24B 15/167*** | (2020.01) |
| ***A24D 1/14*** | (2006.01) |
| ***A24F 7/04*** | (2006.01) |

(52) U.S. Cl.

CPC ..... *A24B 15/167* (2016.11); *A24D 1/14* (2013.01); *A24F 7/04* (2013.01)

(58) Field of Classification Search

None

See application file for complete search history.

(56) References Cited

U.S. PATENT DOCUMENTS

| | | | |
|---|---|---|---|
| 3,255,760 | A | 6/1966 | Selke et al. |
| 3,640,285 | A | 2/1972 | Briskin et al. |
| 4,210,158 | A | 7/1980 | Vinals et al. |
| 4,357,950 | A | 11/1982 | Berger |
| 4,649,944 | A | 3/1987 | Houck, Jr. et al. |
| 4,807,809 | A | 2/1989 | Pryor et al. |

(Continued)

FOREIGN PATENT DOCUMENTS

| | | | |
|---|---|---|---|
| CN | 101442917 | A | 5/2009 |
| CN | 101657114 | A | 2/2010 |

(Continued)

OTHER PUBLICATIONS

Office Action dated Aug. 9, 2023, issued in corresponding Chinese Patent Application No. 201980052985.3.

(Continued)

*Primary Examiner* — Phu H Nguyen

(74) *Attorney, Agent, or Firm* — Harness, Dickey & Pierce, P.L.C.

(57) ABSTRACT

The method includes providing a filler material that is water insoluble, the providing provides the filler material with more than 98% alpha-cellulose, 0.01% to less than 2% ash and a remainder hemicellulose, infusing at least one first consumable within the filler material and inserting a matrix within at least one first containing structure to form a capsule, the matrix including the filler material.

20 Claims, 9 Drawing Sheets

(56) References Cited

U.S. PATENT DOCUMENTS

| | | | |
|---|---|---|---|
| 4,889,143 | A | 12/1989 | Pryor et al. |
| 4,903,714 | A | 2/1990 | Barnes et al. |
| 4,936,920 | A | 6/1990 | Keritsis et al. |
| 5,005,593 | A | 4/1991 | Fagg |
| 5,025,814 | A | 6/1991 | Raker |
| 5,060,669 | A | 10/1991 | White et al. |
| 5,074,320 | A | 12/1991 | Jones, Jr. et al. |
| 5,105,836 | A | 4/1992 | Gentry et al. |
| 5,129,409 | A | 7/1992 | White et al. |
| 5,203,355 | A | 4/1993 | Clearman et al. |
| 5,269,327 | A | 12/1993 | Counts et al. |
| 5,360,023 | A | 11/1994 | Blakley et al. |
| 5,396,909 | A | 3/1995 | Gentry et al. |
| 5,396,911 | A | 3/1995 | Casey et al. |
| 5,505,214 | A | 4/1996 | Collins et al. |
| 5,685,323 | A | 11/1997 | Crooks et al. |
| 5,829,453 | A | 11/1998 | White et al. |
| 5,863,652 | A | 1/1999 | Matsumura et al. |
| 6,289,897 | B1 | 9/2001 | McAdam et al. |
| 7,578,298 | B2 | 8/2009 | Karles et al. |
| 7,647,932 | B2 | 1/2010 | Cantrell et al. |
| 7,726,320 | B2 | 6/2010 | Robinson et al. |
| 8,113,215 | B2 | 2/2012 | Rasouli et al. |
| 8,157,918 | B2 | 4/2012 | Becker et al. |
| 8,186,360 | B2 | 5/2012 | Marshall et al. |
| 8,464,726 | B2 | 6/2013 | Sebastian et al. |
| 8,739,802 | B2 | 6/2014 | Fagg |
| 8,967,155 | B2 | 3/2015 | Bundren et al. |
| 9,004,073 | B2 | 4/2015 | Tucker et al. |
| 9,066,541 | B2 | 6/2015 | Allen et al. |
| 9,072,321 | B2 | 7/2015 | Liu |
| 9,220,301 | B2 | 12/2015 | Banerjee et al. |
| 9,402,422 | B2 | 8/2016 | Shenkal |
| 2005/0053665 | A1 | 3/2005 | Ek et al. |
| 2005/0263165 | A1 | 12/2005 | Oh et al. |
| 2007/0056600 | A1 | 3/2007 | Coleman et al. |
| 2010/0147317 | A1 | 6/2010 | Fallon |
| 2011/0036367 | A1 | 2/2011 | Saito et al. |
| 2011/0271971 | A1 | 11/2011 | Conner et al. |
| 2012/0067359 | A1 | 3/2012 | Clarke et al. |
| 2012/0125354 | A1 | 5/2012 | Byrd et al. |
| 2012/0186594 | A1 | 7/2012 | Liu |
| 2013/0192615 | A1 | 8/2013 | Tucker et al. |
| 2013/0192620 | A1 | 8/2013 | Tucker et al. |
| 2014/0166032 | A1 | 6/2014 | Gindrat |
| 2014/0224268 | A1 | 8/2014 | Ryter |
| 2014/0261486 | A1 | 9/2014 | Potter et al. |
| 2015/0000682 | A1 | 1/2015 | Liu |
| 2015/0027468 | A1 | 1/2015 | Li et al. |
| 2015/0027469 | A1 | 1/2015 | Tucker et al. |
| 2015/0305410 | A1 | 10/2015 | Liu |
| 2016/0106154 | A1 | 4/2016 | Lord |
| 2016/0120224 | A1 | 5/2016 | Mishra et al. |
| 2016/0135506 | A1 | 5/2016 | Sanchez et al. |
| 2016/0143348 | A1 | 5/2016 | Camus et al. |
| 2016/0208440 | A1 | 7/2016 | Byrd, Jr. et al. |
| 2016/0295909 | A1 | 10/2016 | Besso et al. |
| 2016/0295914 | A1 | 10/2016 | Jordil et al. |
| 2016/0295922 | A1 | 10/2016 | John et al. |
| 2016/0295926 | A1 | 10/2016 | Zuber |
| 2016/0302477 | A1 | 10/2016 | Besso |
| 2016/0324216 | A1 | 11/2016 | Li et al. |
| 2017/0064995 | A1 | 3/2017 | Beeson |
| 2017/0145634 | A1 | 5/2017 | Bradbury et al. |
| 2017/0251723 | A1 | 9/2017 | Kobal et al. |
| 2018/0007966 | A1 | 1/2018 | Li et al. |
| 2018/0146713 | A1 | 5/2018 | Robinson et al. |
| 2018/0177233 | A1 | 6/2018 | Tucker et al. |

FOREIGN PATENT DOCUMENTS

| | | | |
|---|---|---|---|
| CN | 101778577 | A | 7/2010 |
| CN | 103796537 | A | 5/2014 |
| CN | 105163611 | A | 12/2015 |
| CN | 107635419 | A | 1/2018 |
| CN | 108201169 | A | 6/2018 |
| EP | 0532329 | A2 | 3/1993 |
| EP | 0569964 | A2 | 11/1993 |
| GB | 1055473 | A | 1/1967 |
| RU | 2110198 | C1 | 5/1998 |
| RU | 2462964 | C2 | 10/2012 |
| RU | 2520878 | C2 | 6/2014 |
| RU | 148293 | U1 | 11/2014 |
| RU | 2565566 | C2 | 10/2015 |
| RU | 2581999 | C2 | 4/2016 |
| RU | 2603597 | C2 | 11/2016 |
| RU | 2612998 | C9 | 5/2017 |
| RU | 2657215 | C2 | 6/2018 |
| SU | 483816 | A3 | 9/1975 |
| SU | 1837814 | A3 | 8/1993 |
| WO | WO-2004/041007 | A2 | 5/2004 |
| WO | WO-2006/117697 | A1 | 11/2006 |
| WO | WO-2007/053097 | A1 | 5/2007 |
| WO | WO-2013034512 | A1 | 3/2013 |
| WO | WO-2013/116558 | A1 | 8/2013 |
| WO | WO-2014/180893 | A1 | 11/2014 |
| WO | WO-2015/013108 | A2 | 1/2015 |
| WO | WO-2015/013135 | A1 | 1/2015 |
| WO | WO-2015/179388 | A1 | 11/2015 |
| WO | WO-2016/159013 | A1 | 10/2016 |
| WO | WO-2017/009298 | A1 | 1/2017 |
| WO | WO-2017/093358 | A1 | 6/2017 |
| WO | WO-2017/174595 | A1 | 10/2017 |
| WO | WO-2018/007633 | A1 | 1/2018 |
| WO | WO-2018/050610 | A1 | 3/2018 |

OTHER PUBLICATIONS

European Office Action dated Sep. 29, 2022, issued in corresponding European Patent Application No. 19 753 575.0.

Notice of Opposition dated Aug. 8, 2023, issued in corresponding European Patent EP3846643.

Decision to Grant dated Jul. 26, 2023, issued in corresponding Russian Patent Application No. 2021109408/03.

Office Action dated Mar. 28, 2023, issued in corresponding Brazilian Patent Application No. 112021002939-7.

"Active Paper Filter", Essentra, www.essentra.com/en/industries/tobacco/filter-range/performance-range/performance-range/vapour-red . . . , Mar. 25, 2018.

Additives in Tobacco Products: Cellulose Fibre' German Cancer Research Center, Jan. 2012, https://www.dkfz.de/de/tabakkontrolle/download/PITOC/PITOC_Tobacco_Additives_Cellulose_Fibre.pdf.

International Search Report and Written Opinion dated Oct. 29, 2019, issued in corresponding PCT Application No. PCT/US2019/045096.

International Search Report and Written Opinion dated Nov. 27, 2019, issued in corresponding PCT Application No. PCT/EP2019/073881.

International Search Report and Written Opinion dated Nov. 27, 2019, issued in corresponding PCT Application No. PCT/EP2019/073892.

International Preliminary Report on Patentability dated Sep. 29, 2020, issued in corresponding International Application No. PCT/EP2019/073881.

Office Action dated Nov. 2, 2020, issued in co-pending U.S. Appl. No. 16/125,399.

Office Action dated Feb. 10, 2021, issued in co-pending U.S. Appl. No. 16/125,399.

International Preliminary Report on Patentability dated Mar. 18, 2021, issued in corresponding International Application No. PCT/US2019/045096.

International Preliminary Report on Patentability dated Mar. 18, 2021, issued in corresponding International Application No. PCT/EP2019/073892.

Advisory Action dated Apr. 5, 2021, issued in co-pending U.S. Appl. No. 16/125,399.

Office Action dated May 19, 2021, issued in co-pending U.S. Appl. No. 16/125,399.

(56) References Cited

OTHER PUBLICATIONS

Office Action dated Sep. 10, 2021, issued in corresponding U.S. Appl. No. 16/125,393.
Notice of Allowance dated Nov. 22, 2021, issued in corresponding U.S. Appl. No. 16/125,399.
European Office Action dated Feb. 10, 2022, issued in corresponding European Patent Application No. 19 753 575.0.
Notice of Allowance dated Mar. 24, 2022 issued in corresponding U.S. Appl. No. 16/125,393.
Office Action and Search Report dated Dec. 22, 2022, issued in corresponding Russian Patent Application No. 2021108891.
Chinese Office Action, dated Sep. 6, 2023, issued in corresponding Chinese Patent Application No. 201980052983.4.
Japanese Office Action, dated Aug. 18, 2023, issued in corresponding Japanese Patent Application No. 2021-512512.
Office Action and Search Report dated Jan. 28, 2023, issued in corresponding Chinese Patent Application No. 201980052985.3.
Office Action and Search Report dated Dec. 13, 2022, issued in corresponding Russian Patent Application No. 2021109408.
Notice of Allowance dated Jun. 1, 2023, issued in corresponding Russian Patent Application No. 2021108891.
Japanese Office Action dated Sep. 28, 2023 for corresponding Japanese Patent Application 2021-512520 and its English-language translation.
Office Action dated May 2, 2023 issued in related European Patent Application No. 19753575.0.
Rejection Decision issued Nov. 8, 2023 in Chinese Application No. 201980052985.3.

METHOD OF MAKING CAPSULE INCLUDING FILLER MATERIAL INFUSED WITH CONSUMABLE

CROSS-REFERENCE TO RELATED APPLICATION

This application is a divisional of U.S. application Ser. No. 16/125,293, filed Sep. 7, 2018, the entire contents of which are incorporated herein by reference.

BACKGROUND

Field

Example embodiments generally relate to a capsule containing a matrix, a device with the matrix and a method of forming the matrix.

Related Art

A heat-not-burn device heats a material to produce an aerosol. The heating process does not involve combustion of the material.

SUMMARY

At least one example embodiment is directed toward a capsule.

In one embodiment, the capsule includes a matrix including, one or more portions of a filler material, the filler material including a cellulose material, the one or more portions defining interstices; a containing structure containing the matrix; and at least one first substance infused within the filler material, the at least one first substance being one of nicotine, at least one first flavorant, a pre-aerosol formulation, a combination thereof, or a sub-combination thereof.

In one embodiment, the filler material is a plant-based cellulose material.

In one embodiment, the filler material is a non-tobacco plant-based cellulose.

In one embodiment, the filler material is a tobacco cellulose.

In one embodiment, the at least one first substance includes nicotine, a weight of the nicotine being between about 1 mg and 15 mg.

In one embodiment, the at least one first substance includes the at least one first flavorant, the at least one first flavorant being a tobacco extract.

In one embodiment, the at least one first substance includes the at least one first flavorant, the at least one first flavorant being a non-tobacco flavorant.

In one embodiment, the at least one first substance includes the at least one first flavorant, the at least one first flavorant being a tobacco extract.

In one embodiment, the at least one first substance includes the at least one first flavorant, the at least one first flavorant being a non-tobacco flavorant.

In one embodiment, the filler material is about 30% to 99% alpha-cellulose material, about 0.01% to 2% ash and a remainder is hemicellulose.

In one embodiment, the capsule further includes a filter.

In one embodiment, the capsule further includes a flow restriction section with a first end and a second end, the first end of the flow restriction section being connected to the matrix.

In one embodiment, the capsule further includes a filter connected to the second end of the flow restriction section, the filter being devoid of a consumable substance.

In one embodiment, the containing structure contacts at least a side surface of the flow restriction section and at least a side surface of the filter to contain the matrix, the flow restriction section and the filter together.

In one embodiment, the flow restriction section defines an internal void space with a flow restrictor in the internal void space, the flow restrictor being spaced apart from one of the first end, the second end, or both the first end and the second end.

In one embodiment, the containing structure is at least one of a mesh, cellulose, plant-based cellulose, fabric, cotton, fibers, threads, textiles, paper, tipping paper, a same material as the filler material, a sub-combination thereof, or a combination thereof.

In one embodiment, the containing structure includes the filler material.

At least another example embodiment is directed toward a device.

In one embodiment, the device includes a heating section including, a first housing, a heating element in the first housing, and a capsule within heating proximity of the heating element, the capsule including, a matrix including, one or more portions of a filler material, the filler material being a plant-based cellulose material, the one or more portions defining interstices, a containing structure containing the matrix, and at least one first substance infused within the filler material, the at least one first substance being one of nicotine, at least one first flavorant, a pre-aerosol formulation, a combination thereof, or a sub-combination thereof, and the first housing defining an air inlet and an air outlet that are configured to establish an airflow path that passes across, passes through or both passes across and passes through the capsule.

In one embodiment, the device further includes a power source; at least one first sensor; and control circuitry in electrical communication with the at least one first sensor and the power source, and the control circuitry being configured to cause the power source to send an electrical current to the heating element.

In one embodiment, the at least one first sensor is configured to detect at least one first parameter, the at least one first parameter being at least one of a resistance of the heating element, a temperature of the heating element, a temperature of the matrix of the capsule, a temperature of the capsule, a draw of air, a sub-combination thereof, or a combination thereof.

In one embodiment, the control circuitry is configured to cause the power source to send the electrical current to the heating element based on the at least one first parameter.

In one embodiment, the electrical current is variable based on the at least one first parameter.

In one embodiment, the capsule further includes, a flow restriction section with a first end and a second end, the first end of the flow restriction section being connected to the matrix; and a filter connected to the second end of the flow restriction section, the filter being devoid of a consumable substance.

In one embodiment, the capsule further includes, a filter connected to an end of a flow restriction section, the filter being devoid of a consumable substance.

In one embodiment, the containing structure contacts at least a side surface of the flow restriction section and at least a side surface of the filter to contain the matrix, the flow restriction section and the filter together, and the flow restriction section defines an internal void space with a flow restrictor in the internal void space, the flow restrictor being spaced apart from one of the first end, the second end, or both the first end and the second end.

In one embodiment, the flow restriction section defines an internal void space with a flow restrictor in the internal void space, the flow restrictor being spaced apart from one of the first end, the second end, or both the first end and the second end.

At least another example embodiment is directed toward a method of forming a matrix.

In one embodiment, the method includes forming a filler material from a plant-based cellulose material; processing the filler material to create a matrix; containing the matrix to form a capsule; and infusing the filler material with at least one first substance, the at least one first substance being one of nicotine, at least one first flavorant, a pre-aerosol formulation, a combination thereof, or a sub-combination thereof.

In one embodiment, the forming of the filler material includes forming the filler material from at least one of a non-tobacco plant-based cellulose, a tobacco cellulose, or both the non-tobacco plant-based cellulose and the tobacco cellulose.

In one embodiment, the containing of the matrix includes enveloping at least a portion of the matrix with a containing structure, the containing structure being configured to allow an airflow to contact at least a portion of the matrix.

In one embodiment, the method further includes connecting a first end of a flow restriction section to the matrix; connecting a second end of the flow restriction section to a filter, the flow restriction section defining an internal void space with a flow restrictor in the internal void space, the flow restrictor being spaced apart from the first end and the second end of the flow restriction section; and containing the matrix, the flow restriction section and the filter together using the containing structure.

In one embodiment, the infusing of the filler material includes adding the at least one first flavorant to the filler material, the at least one first flavorant being at least one of a non-tobacco flavorant, a tobacco extract or both the non-tobacco flavorant and the tobacco extract.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
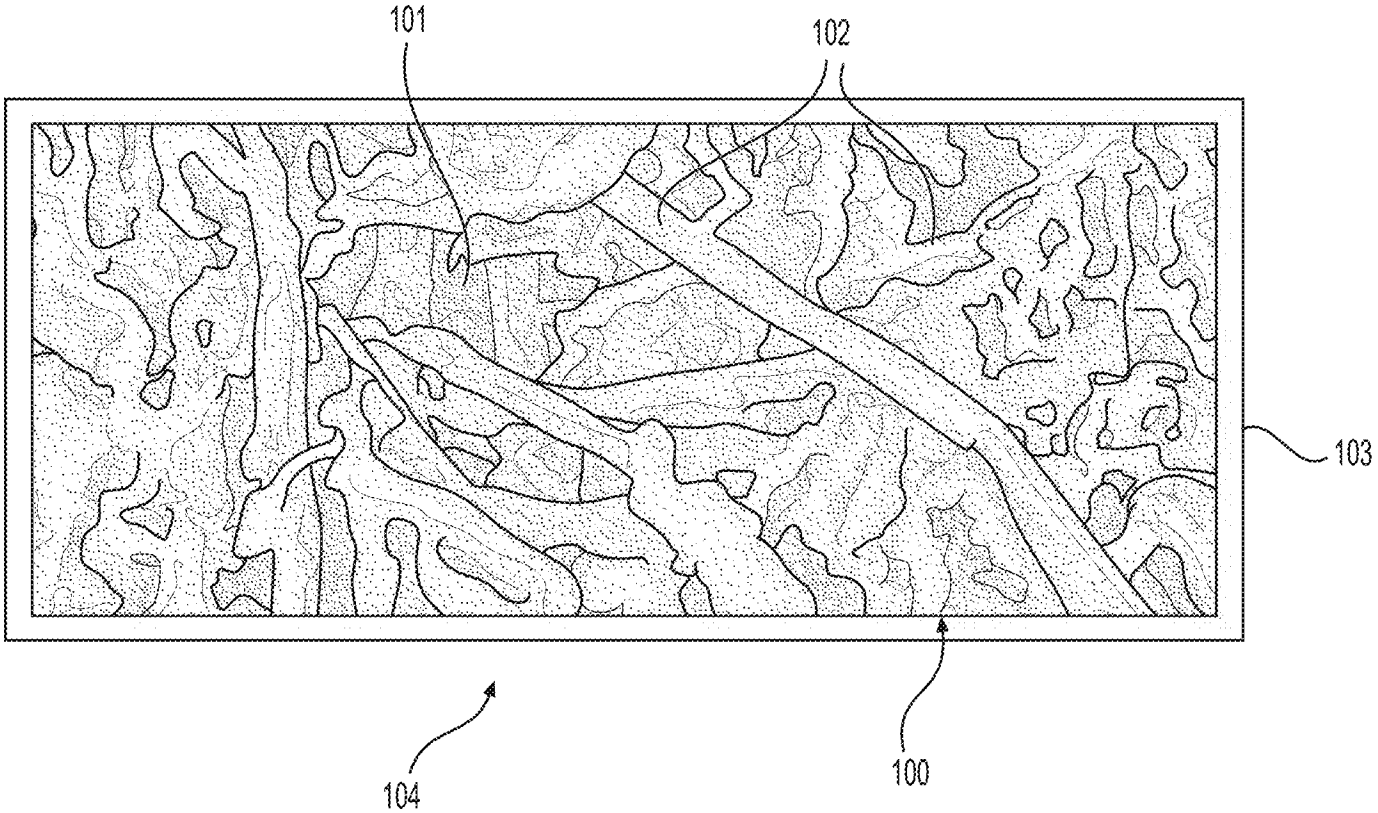
FIG. 1 is an illustration of a matrix, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIG. 1 is an illustration of a matrix 100, in accordance with an example embodiment. In an example embodiment, the matrix 100 includes cut strands 102 of a filler material 105 (shown in FIGS. 2A-2B). The strands 102 define interstices (interstitial spaces) 101 that provide avenues for airflow traveling through the matrix 100. In another example embodiment, in lieu of cutting the filler material 105 into the strands 102 to form the matrix 100, or in addition to the cut strands 102 that form the matrix 100, filler material 105 can be folded, layered, bunched together, otherwise combined and/or compressed into the matrix 100.

In some example embodiment the filler material 105 is also perforated to increase a porosity and/or flow paths through the filler material 105 that is combined to form the matrix 100. In an example embodiment, the matrix 100 is a porous or mesh material, that may be a composite material made from tobacco, non-tobacco materials, or both tobacco and non-tobacco materials. In some example embodiments, the matrix 100 is provided with or without flavors or a flavoring system, and the matrix 100 is provided with or without nicotine.

In an example embodiment, the matrix 100 is contained (e.g., bound together) by a containing structure 103. In an example embodiment, the matrix 100 and the containing structure 103 is in the form of a capsule (cartridge) 104 or a part of the capsule 104. A capsule 104 can be in various shapes or sizes and may include other elements. In an example embodiment, the capsule 104 is sized to include enough of the filler material 105 in the matrix 100, and a concentration of nicotine and/or flavoring (described below) within the filler material 105 of the matrix 100 to provide a determined number of draws and/or a determined numbers of draws over a desired duration of time.

In an example embodiment, the containing structure 103 fully circumscribes the matrix 100. In another example embodiment, the containing structure 103 does not cover all sides of the matrix 100, and may for instance define openings for an entrance and exit airflow. In an example embodiment, the containing structure 103 may include a soft and/or porous covering. In an example embodiment, the containing structure 103 may include a covering made from cellulose, plant-based cellulose, fabric, cotton, fibers, threads, other suitable textiles, paper, tipping paper, or combinations or sub-combinations of these materials, etc. In an example embodiment, the containing structure 103 includes a hard shell made from metal, metal alloys, one or more polymers, plastics, resins, etc., or combinations/sub-combinations thereof. The containing structure 103 and/or the matrix 100 can be in the shape of a cylinder, a rod, a disc, a plug, a flat surface, a square, a rectangle, or any other desirable shape. In an example embodiment, the matrix 100 may be in the shape of a cylinder, and containing structure 103 may be wrapped around the cylinder without covering ends 100*a*. Other shapes or cross-sectional configurations may be used. In an example embodiment, the containing structure 103 includes a soft covering made from cellulose, plant-based cellulose, fabric, cotton, fibers, threads, other suitable textiles, combinations or sub-combinations of these materials, etc. In an example embodiment, the containing structure 103 is made from the filler material 105. In an example embodiment, the containing structure 103 is porous. The containing structure 103 and/or the matrix 100 of some example embodiments is suitable for allowing airflow to pass along and/or through at least a portion of the matrix 100. In some example embodiments, the containing structure 103 may allow airflow to pass through at least a portion of the containing structure 103, itself.

Filler Material According to Some Example Embodiments

Figure 2A:
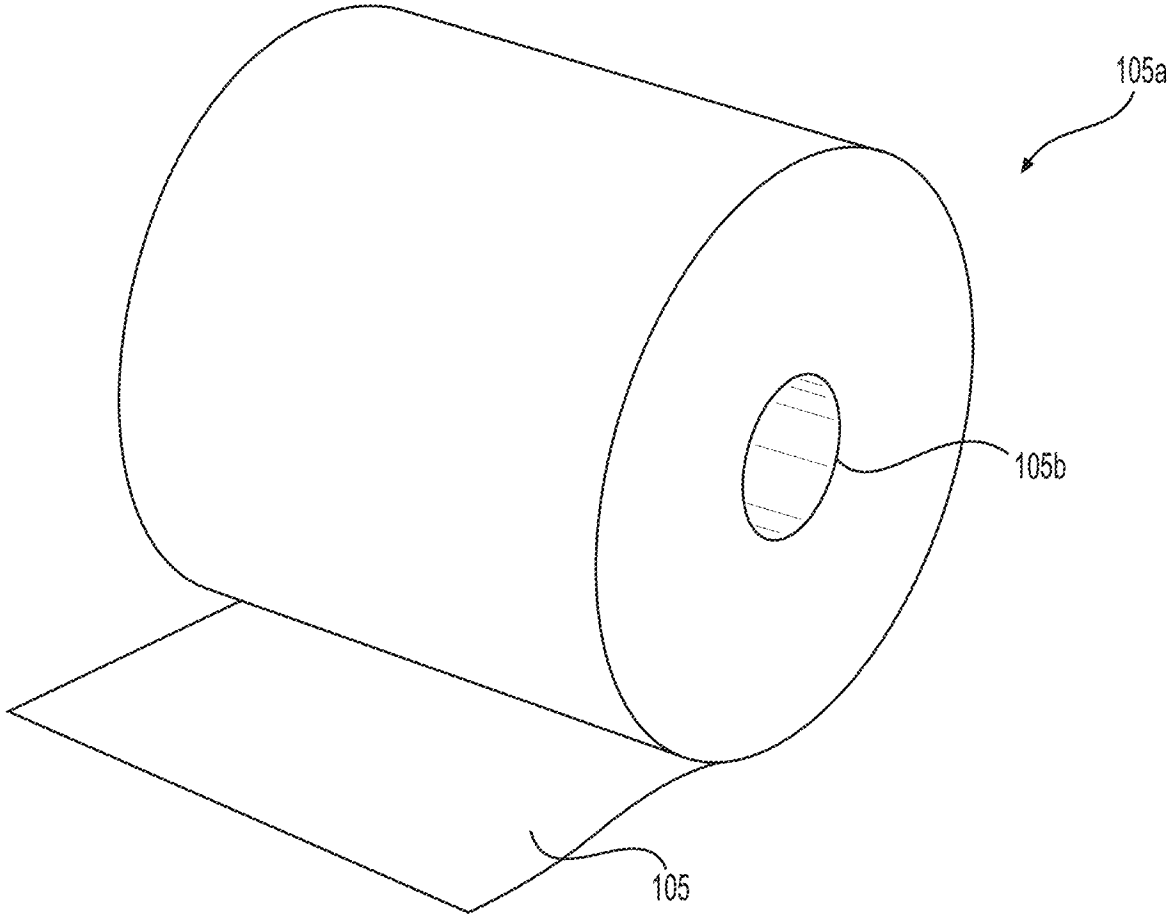
FIG. 2A is an illustration of a roll of filler material, in accordance with an example embodiment.

FIG. 2A is an illustration of a roll 105*a* of filler material 105, in accordance with an example embodiment. In this embodiment, the filler material 105 is a flat-sheet-like material, where the filler material 105 may be processed and/or stored onto rolls 105*a* for convenience. The roll 105*a* may optionally include a mandrel 105*b* that may support the roll 105*a* of the filler material 105.

In other example embodiments, the filler material 105 is a block of material, an extruded material, or a material that is in a shape other than a flat sheet.

Figure 2B:
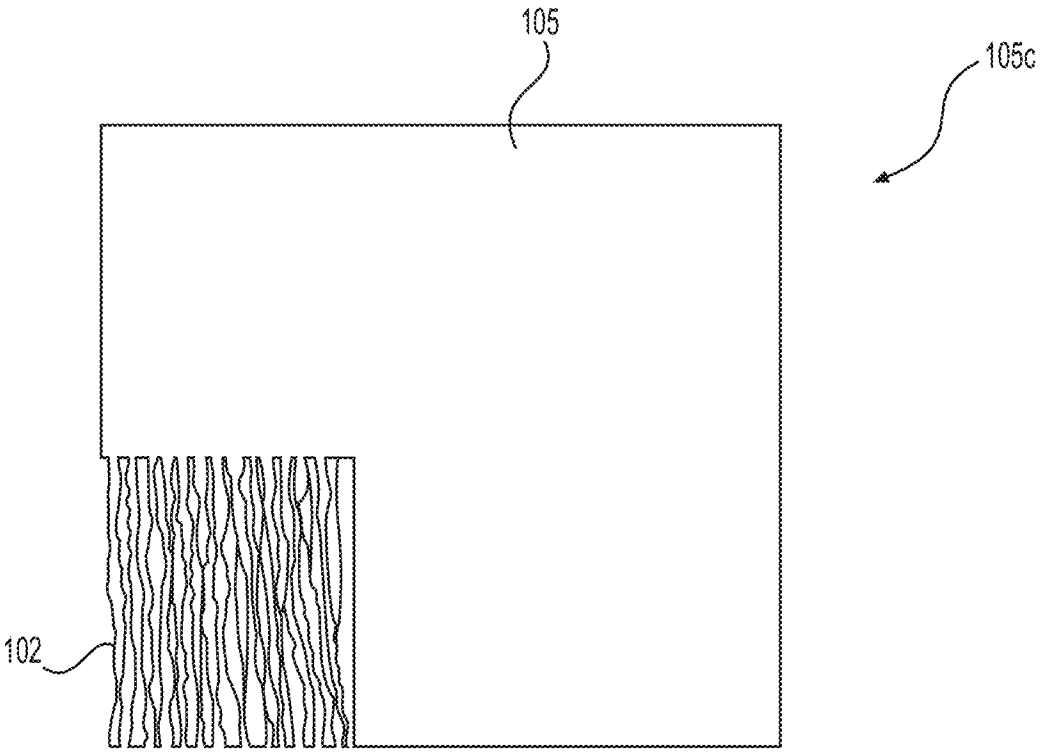
FIG. 2B is an illustration of a sheet of filler material being shredded into strands, in accordance with an example embodiment.

FIG. 2B is an illustration of a sheet 105*c* of the filler material 105, in accordance with an example embodiment. The sheet 105*c* may remain attached to the roll 105*a* during further processing of the filler material 105, or the sheet 105*c* may be cut from the roll 105*a*. Optionally, the sheet 105*c* of filler material 105 may be formed and stored as the sheet 105*c*, such that the sheet 105*c* is not part of a roll 105*a*. In another example embodiment, the filler material 105 may be formed and processed as a block of material, or another shape of the filler material 105, such that the filler material 105 is not in the form of the sheet 105*c*.

In an example embodiment, the filler material 105 is shredded into the strands 102. The strands 102 are combined to form the matrix 100 (FIG. 1). In an example embodiment, the filler material 105 has an initial sheet 105*c* thickness of about 100 micrometers and a density of about 87 g/cm$^2$, prior to being cut of shredded into the strands 102. In an example embodiment, the sheet 105*c* of filler material 105 is porous, with a pore size that is about 10-12 micrometers, or about 11 micrometers. In an example embodiment, the strands 102 of the filler material 105 have a width of about 1-3 mm, with the understanding that the thickness of the strands 102 may correspond to the sheet 105*c* thickness of the filler material 105 in the event the strands 102 are formed by starting with the sheet 105*c* of the filler material 105. The filler material 105 can be considered a 'functional filler material' from the standpoint that it can include flavoring, nicotine, and/or pre-aerosol formulation, as described herein. The ranges of values in these example embodiments are not limiting and may be below or above these ranges.

It should be understood that the strands 102 may formed via other processes, other than shredding. For instance, cutting, dicing, or other processes may be used to form the strands 102. In another example embodiment, the strands 102 may be formed via extrusion, such that the filler material 105 is not necessarily in a sheet-like form, prior to the formation of the strands 102. In another example embodiment, as discussed above, the filler material 105 is folded or bunched together to form the matrix 100, where the folded and/or bunched together filler material 105 may or may not also be perforated, either before or after forming the matrix 100. In yet another example embodiment, the filler material 105 may be processed so that the shredded and/or cut strands 102 of the filler material 105 are combined with folded and/or bunched together filler material 105 that is not cut and/or shredded, in order to form the matrix 100.

Filler Material: Non-Tobacco Cellulose Example Embodiments

In an example embodiment, the filler material 105 is a non-tobacco cellulose. In particular, the non-tobacco cellulose is cast or made into the filler material 105, where in an example embodiment the filler material 105 is in the form of the sheet-like (paper-like) 105*c* layer that may or may not be rolled 105*a*. The cellulose is a water-insoluble organic polymer material that may be made from plant material, plant-based material, plant cell walls, vegetable fibers, cotton, polysaccharide, chains of glucose units (monomers), cellulose acetate, combinations or sub-combinations of these materials, etc. In another example embodiment, the cellulose is partially water-soluble and made from the same materials, or combinations, or sub-combinations, of the materials, etc.

In an example embodiment, the filler material 105 is about 30% to 99% alpha-cellulose material made from plant material, about 0.01% to 2% ash and the remainder is hemicellulose. In an example embodiment, the hemicellulose is plant based material that includes beta-cellulose, gamma-cellulose, biopolymers, or combinations, or sub-combinations, thereof. In some examples, the primary strength and water-insoluble properties of the filler material 105 may be derived from the content of alpha-cellulose within the filler material 105. In an example embodiment, the filler material 105 is more than 98% alpha-cellulose material made from plant material, about 0.01% to 2% ash, and is water-insoluble and the remainder is hemicellulose—where this embodiment of the filler material 105 is water-insoluble. The ranges of values in these example embodiments are not limiting and may be below or above these ranges.

Filler Material: Tobacco Cellulose Example Embodiments

In another example embodiment, the filler material 105 is a plant-based tobacco cellulose. In particular, the tobacco cellulose is cast or made into the filler material 105, where the filler material 105 may be in the form of the sheet-like (paper-like) 105*c* layer that may or may not be rolled. In an example embodiment, the filler material 105 is a tobacco cellulose that may or may not include tobacco extract. In other embodiments, the cellulose is a non-tobacco cellulose that includes a tobacco extract. In an example embodiment, the tobacco cellulose is a water-insoluble material, or alternatively a partially water-soluble material.

In an example embodiment, the filler material 105 is about 30% to 99% tobacco cellulose, about 0.01% to 2% ash and the remainder is hemicellulose. In another example embodiment, the filler material 105 is more than 98% tobacco cellulose, and about 0.01% to 2% ash, and is water-insoluble. The ranges of values in these example embodiments are not limiting and may be below or above these ranges.

Flavoring According to Some Example Embodiments

In an example embodiment, flavoring, a flavorant, or a flavor system, is included in the strands 102 and/or filler material 105 of the matrix 100 in order to release an aroma and/or flavors during operation, including in some cases, upon heating and/or as an airflow passes through the matrix 100. In an example embodiment, the flavoring includes volatile tobacco flavor compounds. Flavoring may also include flavors besides tobacco, or in addition to tobacco flavoring. The flavoring may be at least one flavorant that is a natural flavorant or an artificial flavorant. For instance, the at least one flavorant may include tobacco flavor, tobacco extract, menthol, wintergreen, peppermint, herb flavors, fruit flavors, nut flavors, liquor flavors, roasted, minty, savory, cinnamon, clove, and any other desired flavors, and combinations or sub-combinations thereof. In an example embodiment, the flavoring is added to the filler material 105, either before or after the filler material 105 is processed into a sheet-like material, or before or after the filler material 105 is shredded, or otherwise transformed, into the strands 102. In some example embodiments, this may be accomplished by dipping the filler material 105 and/or the strands 102 in the flavoring, dispersing the flavoring onto the filler material 105 and/or strands 102, or otherwise exposing the filler material 105 and/or strands 102 to the flavoring.

In an example embodiment, the flavoring is infused into the filler material 105 during an initial formation and/or processing of the filler material 105. In an example embodiment, the flavoring is also or alternatively infused into the filler material 105 after the initial formation and/or processing of the filler material 105 and/or strands 102. In another example embodiment, the filler material 105 and/or strands 102 of the matrix 100 are left unflavored, such that flavoring is not included in the matrix 100.

Flavoring: Non-Tobacco Flavoring Example Embodiments

In addition to the examples disclosed above, in an example embodiment the flavoring/flavorant is added to the filler material 105, or the strands 102 made from the filler material 105. The non-tobacco flavoring can include a 'tobacco flavoring' that is not tobacco. That is to say, this flavoring is not a tobacco extract, it is not derived from tobacco, and does not include any tobacco material in any form—and yet, this aromatic flavoring sensorially mimics (e.g., smells and/or tastes like) tobacco.

Nicotine for Some Example Embodiments

In an example embodiment, nicotine is included in the strands 102 of the matrix 100. In one example embodiment, about 1-15 mg of nicotine is included in the matrix 100. Less or more nicotine may be used in other example embodiments. In an example embodiment, the matrix 100 contains enough nicotine that the initial (first) five "draws" of the matrix 100 includes about 100-500 micrograms of nicotine per draw. Less or more nicotine may be used in the matrix 100 in other example embodiments to obtain other results. A "draw" is defined to be about 55 $cm^3$ of fluid that flows for a period between about 3-5 seconds.

In an example embodiment, nicotine is added to the filler material 105, either before or after the filler material 105 is processed into a sheet-like layer, or before or after the filler material 105 is shredded, or otherwise transformed, into the strands 102. In some example embodiments, this may be accomplished by dipping the filler material 105 and/or the strands 102 in the nicotine, dispersing the nicotine onto the filler material 105 and/or strands 102, or otherwise exposing the filler material 105 and/or the strands 102 to the nicotine.

In an example embodiment, the nicotine is infused into the filler material 105 during an initial formation and/or processing of the filler material 105. In an example embodiment, the nicotine is also or alternatively infused into the filler material 105 after the initial formation and/or processing of the filler material 105 and/or strands 102. In another example embodiment, nicotine is not included in the filler material 105, the strands 102 or the matrix 100.

Example Embodiments with Pre-Aerosol Formulation

In an example embodiment, the flavoring and/or nicotine is included in a pre-aerosol formulation, and then the pre-aerosol formulation with the flavoring and/or nicotine is infused into the filler material 105. The flavoring, nicotine and/or pre-aerosol formulation is collectively referred to as a "consumable substance." In another embodiment, the pre-aerosol formulation is infused into the filler material 105 separately from the flavoring and/or nicotine. The pre-aerosol formulation is a material or combination of materials that is transformed into an aerosol. Aerosol, vapor and dispersion are terms used interchangeably and are meant to cover any matter generated or output by the devices claimed and equivalents thereof. The pre-aerosol formulation may also be a pre-vapor formulation or a pre-dispersion formulation.

In an example embodiment, the pre-aerosol formulation is a liquid, solid and/or gel formulation including, but not limited to, water, beads, solvents, active ingredients, ethanol, plant extracts, natural or artificial flavors, and/or at least one aerosol former such as glycerin and propylene glycol.

In an example embodiment, at least one aerosol former is included in the pre-aerosol formulation, where the aerosol former includes diols (such as propylene glycol and/or 1,3-propanediol), glycerin and combinations, or sub-combinations, thereof. Various amounts of the aerosol former may be used. For example, in some example embodiments, the at least one aerosol former is included in an amount ranging from about 20% by weight based on the weight of the pre-aerosol formulation to about 90% by weight based on the weight of the pre-aerosol formulation (for example, the aerosol former is in the range of about 50% to about 80%, or about 55% to 75%, or about 60% to 70%), etc. Moreover, in an example embodiment, the pre-aerosol formulation includes a weight ratio of the diol to glycerin that ranges from about 1:4 to 4:1, where the diol is propylene glycol, or 1,3-propanediol, or combinations thereof. In an example embodiment, this ratio is about 3:2. Other amounts or ranges may be used.

In an example embodiment, the pre-aerosol formulation also includes water. Various amounts of water may be used. For example, in some example embodiments, water may be included in an amount ranging from about 5% by weight based on the weight of the pre-aerosol formulation to about 40% by weight based on the weight of the pre-aerosol formulation, or in an amount ranging from about 10% by weight based on the weight of the pre-aerosol formulation to about 15% by weight based on the weight of the pre-aerosol formulation. Other amounts or percentages may be used. For example, in an example embodiment, the remaining portion of the pre-aerosol formulation that is not water (and nicotine and/or flavoring compounds), is the aerosol former (described above), where the aerosol former is between 30% by weight and 70% by weight propylene glycol, and the balance of the aerosol former is glycerin. Other amounts or percentages may be used.

In an example embodiment, the pre-aerosol formulation includes the flavorant in an amount ranging from about 0.2% to about 15% by weight (for instance, the flavorant may be in the range of about 1% to 12%, or about 2% to 10%, or about 5% to 8%). In an example embodiment, the pre-aerosol formulation includes nicotine in an amount ranging from about 1% by weight to about 10% by weight (for instance, the nicotine is in the range of about 2% to 9%, or about 2% to 8%, or about 2% to 6%). In an example embodiment, the portion of the pre-aerosol formulation that is not nicotine and/or the flavorant, includes 10-15% by weight water, where the remaining portion of the non-nicotine and non-flavorant portion of the formulation is a mixture of propylene glycol and an aerosol former where the mixture is in a ratio that ranges between about 60:40 and 40:60 by weight. Other combinations, amounts or ranges may be used.

Device Example According to Example Embodiments

Figure 3:
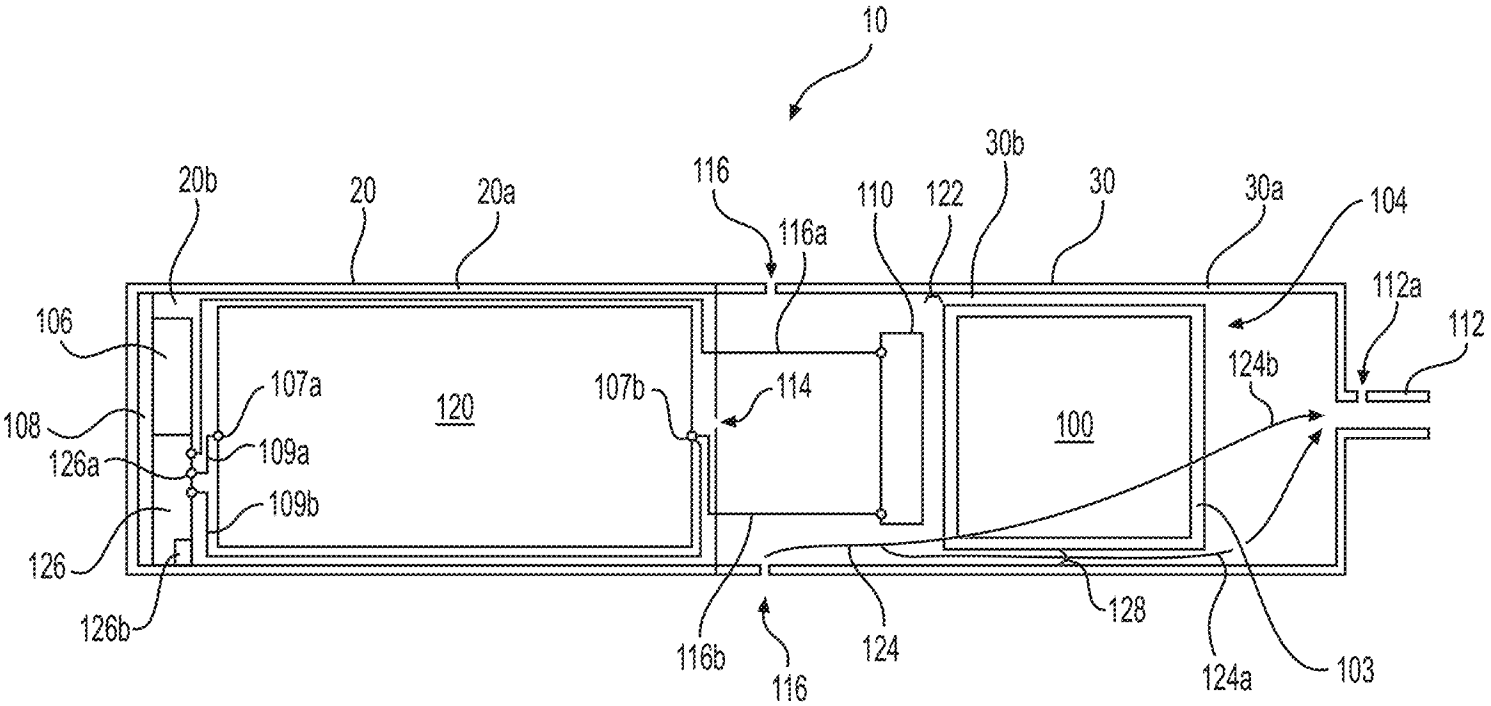
FIG. 3 is a diagram of a device with the matrix, in accordance with an example embodiment.

FIG. 3 is a diagram of a device 10 with a matrix 100, in accordance with an example embodiment. The device is considered to be a 'heat-not-burn' device. In an example embodiment, the device 10 includes two sections: a power section 20 and a heating section 30. The power section 20 may be a rechargeable, non-disposable section, or alternatively the power section may be disposable. As explained below in more detail, the heating section 30 may be disposable, or the heating section may instead be non-disposable.

In another example embodiment, the device 10 is one singular section that includes the elements shown in FIG. 3, rather than being formed from different sections. In other example embodiments, the elements of FIG. 3 are included in more than two sections.

The heating section 30 of the device 10 includes a chamber **30*b* that includes the matrix 100. As stated above in relation to the example of FIG. 1, in an example embodiment the matrix 100 includes the containing structure 103. Also as stated above, in an example embodiment the matrix 100 is in the form of the capsule 104. In an example embodiment, the heating section 30 is rechargeable and non-disposable. In this embodiment, the capsule 104 and/or matrix 100 may be removable, and the capsule 104 and/or matrix 100 may allow for the flavoring system and/or nicotine to be added or recharged within the capsule 104 and/or matrix 100, so that the capsule 104 and/or matrix 100 can then be re-installed in the chamber 30*b* of the heating section 30. In another example embodiment, the capsule 104 and/or matrix 100 may be removable and replaceable with a new capsule 104 and/or matrix 100, where the capsule 104 and/or the matrix 100 may be disposable. Or, the containing structure 103 of the capsule 104 may be removable, or remain affixed within the device 10, where only the matrix 100 may be removed and replaced from the containing structure 103, such that the containing structure 103 is reusable and the matrix 100 is replaceable. In yet another example embodiment, rather than the capsule 104 and/or matrix 100 being removable and replaceable, or in addition to the capsule 104 and/or matrix 100 being removable and replaceable, the heating section 30 may allow for access to the matrix 100 and/or the capsule 104 in order to allow a flavoring system or nicotine to be added or recharged within the matrix 100 and/or the capsule 104**.

The matrix 100 resides in or near an airflow path 124 that is defined by the device 10. This airflow path 124 may be formed, for instance, by defining one or more air inlets 116 in the housing 30*a* of the heating section 30, with an airflow exit provided by a mouthpiece 112 (e.g., air outlet). The airflow path 124 may pass across the matrix 100, or directly through the matrix 100. In an example embodiment, the heating section 30 allows a bypass airflow path 124*a* to pass across and/or completely circumvent the matrix 100. This embodiment may be accomplished by, for instance, providing a gap 128 between the matrix 100 and/or the containing structure 103 of the capsule 104 and an inner surface of the housing 30*a* of the heating section 30. It should be understood that, in the event the device 10 includes a bypass airflow 124*a*, this bypass airflow 124*a* may include an entrained aerosol just as a downstream aerosol 124*b* (that passed through the matrix 100) also includes an aerosol, if the bypass airflow 124*a* passes across an exposed surface of the matrix 100.

In another example embodiment, the heating section 30 allows the entire airflow path 124 to pass through the matrix 100, such that a bypass airflow 124*a* is not present. That is to say, the gap 128 of FIG. 3 would be removed. In an example embodiment, a dilution air inlet 112*a* may be located downstream of the matrix 100, where the dilution air inlet 112*a* may allow ambient air to mix with the aerosol 124*b* and the bypass airflow 124*a*.

A heating element 110 is included in the heating section 30. The heating element 110 is capable of heating the chamber 30*b* and the matrix 100 to an extent that the flavoring, nicotine and/or ingredients in a pre-aerosol formulation in the matrix 100 is at least partially extracted (e.g., aerosolized) to create the aerosol 124*b* (and the bypass airflow 124*a* that may contain aerosol) that is extracted from the matrix 100. The heating element 110 heats the chamber 30*b* and the matrix 100 to an extent that the matrix 100 and the flavoring, nicotine and/or pre-aerosol formulation remain below a combustion temperature. That is to say, in some example embodiments, the heating element 110 does not combust any material in the matrix 100, including the flavoring, nicotine and/or pre-aerosol formulation.

In an example embodiment, the heating element 110 is a distance 122 apart from the matrix 100, such that the heating element 110 utilizes convection to heat air in the housing 30*a* to indirectly heat the matrix 100. In an example embodiment, the distance 122 is negligible and/or non-existent, such that the heating element 110 is nearly touching, or is in direct contact, with the matrix 100 or the containing structure 103 of the matrix 100. In an example embodiment, the heating element 110 uses both conduction and convection to heat the matrix 100. In another example embodiment, the heating element 110 is partially or fully insertable into some or all of the matrix 100 or the containing structure 103 of the matrix 100. In another example embodiment, the heating element 110 contacts or circumscribes one or more sides, or surrounds or nearly surrounds the matrix 100 and/or the containing structure 103. In an example embodiment, the housing 30*a* of the heating section 30 is made from a material that is heat-insulating (e.g., a thermal insulator). The housing 30*a* may be made from a metal, metal alloy, polymer, plastic, resin, other suitable heat-insulating materials, and combinations or sub-combinations thereof.

In at least one example embodiment, the heating element 110 is formed of any suitable electrically resistive materials. In an example embodiment, the heating element 110 is in the form of a wire coil, a planar body, a ceramic body, a single wire, a cage of resistive wire, or any other suitable form that heats the matrix 100. In an example embodiment, the heating element 110 is made from a sintered ceramic material that includes metal particles infused within the ceramic. In another example embodiment, the heating element 110 is constructed of an iron-aluminide (e.g., FeAl or $Fe_3Al$).

The power section 20 includes one or more chambers 20*b* defined by the housing 20*a*, where the chamber 20*b* includes the power source 120. The power source 120 may be a battery. In particular, the power source 120 may be a Lithium-ion battery, or one of its variants, for example a Lithium-ion polymer battery. Alternatively, the battery may be a Nickel-metal hydride battery, a Nickel cadmium battery, a Lithium-manganese battery, a Lithium-cobalt battery, a fuel cell or a solar cell. Any other power sources or battery technology may be used. In an example embodiment, the power source 120 is rechargeable and re-useable, where the power source 120 is charged via an external source, solar power, etc. In another example embodiment, the power source 120 is not rechargeable and is therefore disposable.

In an example embodiment, the power section 20 includes at least one sensor 106 (referred to as a "sensor," throughout the remainder of this document) and control circuitry 126. The sensor 106 can be located anywhere in the device 10. The control circuitry 126 has one or more electrical terminals 126*a* for electrically connecting the control circuitry 126 to the sensor 106 and other elements of the device 10. In an example embodiment, the sensor 106 is in a fluid communication path that includes the chamber 20*b* of the power section 20, the chamber 30*b* of the heating section 30, and one or more holes 114 that open into both chambers 20*b*/30*b*. In an example embodiment, the sensor 106 measures a pressure drop in this fluid communication path. The sensor 106 and control circuitry 126 may be mounted on a printed circuit board 108. In an example embodiment, the sensor 106 and/or control circuitry 126 are positioned at a different location in the power section 20, other than the location that is shown in FIG. 3, where the sensor 106 and/or control circuitry 126 may for instance be proximally near the hole 114 that communicates with both sections 20/30.

Example Operation of Some Example Embodiments

In an example embodiment, the sensor 106 detects one or more parameters within the device 10 and sends one or more signals to the control circuitry 126. In an example embodiment, in response to receiving one or more signal from the sensor 106 the control circuitry 126 closes an 'electrical circuit' that provides an electrical current from the power source 120 to the heating element 110 to cause the heating element 110 to the heat the chamber 30*b* of the heating section 30 and/or the matrix 100. In an example embodiment, the 'electrical circuit' of the device 10 includes the following: the power source 120, terminals 107*a* and 107*b* of the power source 120, electrical leads 109*a* and 109*b* connected to the terminals 107*a/b*, the control circuitry 126 and the electrical terminals 126*a* of the control circuitry 126, the heating element 110 and electrical leads 116*a* and 116*b* connected to the heating element 110. In other example embodiments, the electrical circuit may include the housing 20*a* of the power section 20 and/or the housing 30*a* of the heating section 30, where the housing 20*a*/30*a* may take the place of, or be used in addition to, the electrical leads 109*a/b* and 116*a/b* within the electrical circuit of the device 10. The housings 20*a*/30*a* in FIG. 3 may be the same or different shapes, such as for example cylindrical, square, rectangular, triangular, polygonal, curved, irregular, etc.

In an example embodiment, the sensor 106 generates an output signal indicative of a magnitude and direction of airflow 124 through the heating section 30, where the control circuitry 126 receives the sensor 106 output signal and determine if the following internal conditions exist: (1) a direction of the airflow 124 indicates a draw on the mouthpiece 112 (versus blowing air through the mouthpiece 112), and/or (2) a magnitude of the airflow 124 exceeds a threshold value. In some example embodiments, only one condition may be sufficient to activate the heater, while in other examples, two conditions or all conditions may have to be met before activating the heater. If these internal conditions of the device 10 are met, the control circuitry 126 electrically closes the electrical circuit to connect the power source 120 to the heating element 110, thereby activating the heating element 110 by sending an electrical current to the heating element 110. In an example embodiment, the sensor 106 generates a variable output signal that is in at least partial correlation with a magnitude of the pressure drop sensed by the sensor 106.

In another example embodiment, the control circuitry 126 may include, or be in electrical communication with, a measurement circuit 126*b*, where the measurement circuit 126*b* is capable of detecting a change in resistance or a temperature of the heating element 110, as discussed below in more detail. In this embodiment, the control circuitry 126 may send a variable electrical current to the heating element 110 based on the variable output signal from the sensor 106. The sensor 106 may be a sensor as disclosed in "Electronic Smoke Apparatus," U.S. application Ser. No. 14/793,453, filed on Jul. 7, 2015, or a sensor as disclosed in "Electronic Smoke," U.S. Pat. No. 9,072,321, issued on Jul. 7, 2015, each of which are hereby incorporated by reference in their entirety into this document. Other type of sensors to detect an airflow may be used.

In an example embodiment, the device 10 with the containing structure 103 and/or matrix 100 has a resistance to draw (RTD) between about 5 mm water to 150 mm of water. Other RTD may be implemented, such as for example, in some embodiments, the RTD may be below 5 mm of water or above 150 mm of water. It should be understood that the RTD of the matrix 100 lessens over time as the matrix 100 is in operational use, and therefore the RTD of the device 10 also lessens over time while in operation.

Insert Examples According to Example Embodiments

Figure 4A:
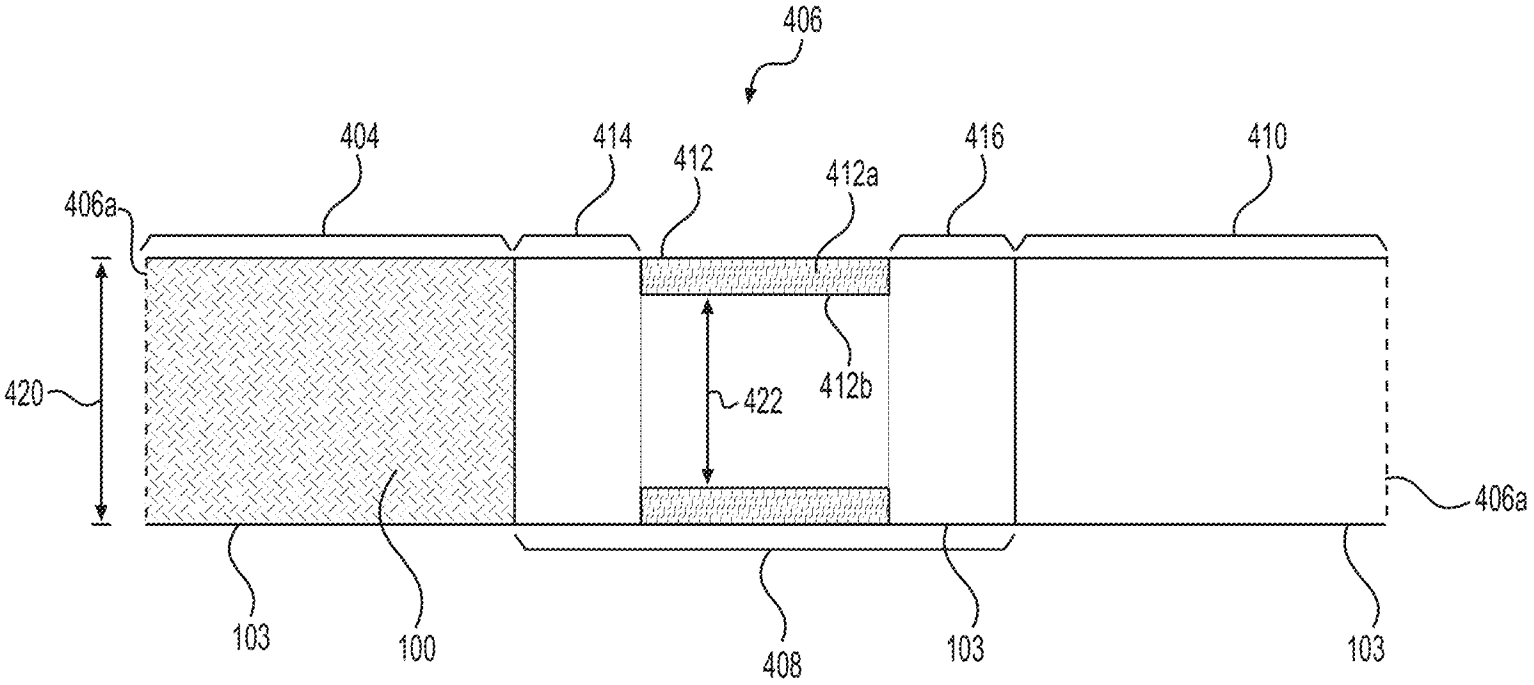
FIG. 4A is an illustration of a side-view of the matrix in an insertable rod, in accordance with an example embodiment.

FIG. 4A is an illustration of a side-view of the matrix 100 in an insert (insertable rod) 406, in accordance with an example embodiment. In an example embodiment, the insert 406 includes at least three sections: a proximal end section 404 that includes the matrix 100, a middle section 408, and a distal end section that is a filter 410. The filter 410 in some example embodiments is a non-consumable filter that does not include a consumable substance (e.g., the 410 is devoid of a consumable substance). The insert 406 has a "plug-space-plug" configuration, from the standpoint that the middle section 408 is largely a section of open (void) space (e.g., wrapped by a tipping paper that can also wrap the other sections). In some examples, the middle section 408 may include a flow restrictor 412 in the middle section 408. In an example embodiment, the flow restrictor 412 may be in the form of a tube with walls 412*a*, where an internal surface 412*b* of the tube walls forms a restricted flow channel with an internal diameter 422. In an example embodiment, the middle section 408 defines open spaces 414/416 that bracket the flow restrictor 412, such that the flow restrictor 412 does not reach the ends of the middle section 408. In some examples, the flow restrictor 412 may reach both ends of the middle section 408, or may reach one end but not both ends of the middle section 408. The reduced internal diameter 422 of the flow restrictor 412 reduces an airflow cross-sectional area through the middle section 408 to control a RTD and an airflow through the insert 406. The filter 410 is a filter that may be, for instance, a cellulose acetate (CA) filter. In an example embodiment, the filter 410 (or other filters described in various embodiments) may also contain nicotine, flavorants, etc. In some embodiments, flavorant beads and/or crushable beads may be included in one or more of the sections. In an example embodiment, an airflow through the insert 406 flows in a direction that causes the airflow to enter and flow through the matrix 100, before passing through the middle section 408 and the filter 410. In some examples, and insert 406 may include less than three sections or more than two sections. For example, one example may include a filter section and a matrix section as has been described, or another example may include a sections such as middle section 408 and a matrix section, and in other examples may then include three sections with additional spaces, sections such as middle section 408, filter sections and/or matrix sections.

In an example embodiment, the insert 406 includes the containing structure 103 that spans the length of the insert 406, by covering the outer surfaces of the matrix 100, the middle section 408 and the filter 410 and/or any other sections that may form part of the insert 406. In an example embodiment, the only wrapping around the matrix 100, middle section 408, filter section 410 and/or any other sections that may form part of the insert 406, is a containing structure 103 without any other wrapping around each of the sections that form part of insert 406 (i.e., the sections being wrapped only by and connected by a single wrapping such as containing structure 103). In an example embodiment, the containing structure 103 is made from tipping paper. In another embodiment, the containing structure 103 is made from any of the materials described in conjunction with the containing structure 103, included in the embodiments described herein. In an example embodiment, the ends 406*a* of the insert 406 are open (e.g., the containing structure 103 is only wrapped around insert 406 in a longitudinal direction, such that the containing structure 103 does not exist on the ends 406*a* of the rod 406). In another embodiment, the containing structure 103 exists on the ends 406*a* of the insert 406 are made from any of the materials for the containing structure 103 of the example embodiments described herein. The insert 406 can be referred to as a "capsule" for purposes of this document. One or more sections may also have their own cover, and then the various sections may be connected together, either by another covering or by other structure.

Dimensions and Performance in Some Example Embodiments

In an example embodiment, the diameter 420 of the insert 406 is about 7-10 mm, or about 8.6 mm. In an example embodiment, the internal (restricted) diameter 422 of the flow restrictor 412 is about 4-8 mm, or about 5 mm. In an example embodiment, a longitudinal length of the end section 404 with the matrix 100 is about 5-16 mm, or about 6 mm. In an example embodiment, a longitudinal length of the middle section (flow restriction section) 408 is about 12-25 mm, or about 12 mm. In an example embodiment, the spaces 414/416 of the middle section 408 may each have a longitudinal length of about 4 mm. In an example embodiment, a longitudinal length of the non-consumable filter 410 is about 6-9 mm, or about 6 mm. In an example embodiment, the RTD of the insert 406 is about 30 mm of water or less, or about 26 mm of water or less. In an example embodiment, the insert 406 has the following dimensions: the end section 404 with the matrix 100 has a longitudinal length of about 6 mm, the middle section 408 has a longitudinal length of about 12 mm with spaces 414/416 that are each about 4 mm long, and the non-consumable filter 410 has a longitudinal length of about 6 mm—with a RTD of the insert 406 being about 26 mm of water or less. It should be understood that the existence of the void space within the middle section 408, and a size of the internal diameter 422 of the flow restrictor 412, help control an airflow rate and a RTD of the insert 406, where a lower RTD generally allows a greater amount of flavor and/or nicotine to be imparted to the downstream aerosol 124*b* exiting the insert 406 (see FIG. 5). The ranges of values in these example embodiments are not limiting and may be below or above these ranges.

In an example embodiment, the insert 406 is disposable, such that the insert 406 may be discarded following a depletion of the consumable substance within the matrix 100.

Figure 4B:
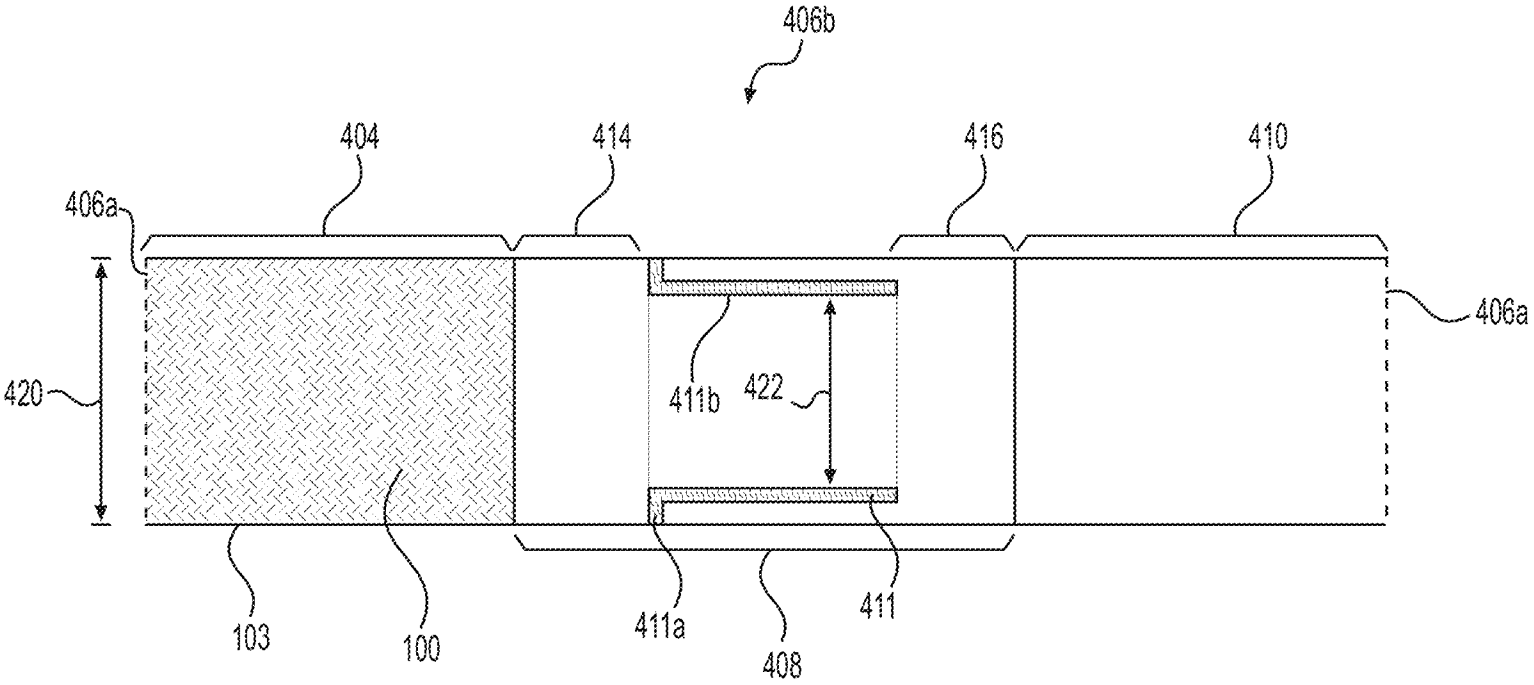
FIG. 4B is an illustration of a side-view of the matrix in an insertable rod, in accordance with an example embodiment.

FIG. 4B is an illustration of a side-view of the matrix 100 in another insert (insertable rod) 406*b*, in accordance with an example embodiment. Reference numbers in common with FIG. 4A are not described again here, for brevity sake. In this example embodiment, a flow restrictor 411 is in the middle section 408, where the flow restrictor 411 is a "hat" flow restrictor. In this example embodiment, the flow restrictor 411 relies on a brim 411*a* of the flow restrictor 411 to provide the reduced cross-sectional airflow through the flow restrictor 411, where an internal surface 411*b* of the flow restrictor 411 defines a channel with the restricted diameter 422. In an example embodiment, an airflow through the insert 406*b* flows in a direction that causes the airflow to enter and flow through the matrix 100, before passing through the middle section 408 and the non-consumable filter 410. The insert 406*b* may be referred to as a "capsule" for purposes of this document.

Figure 5:
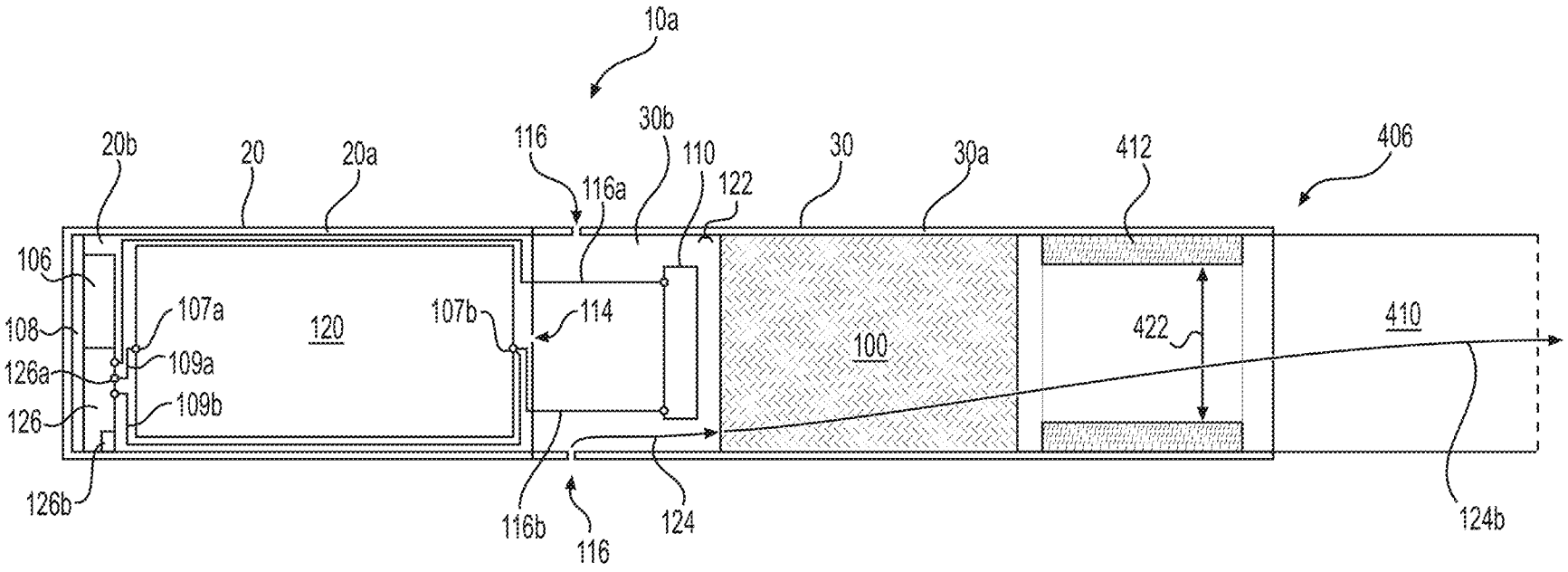
FIG. 5 is a diagram of a device with the matrix in the insertable rod, in accordance with an example embodiment.

FIG. 5 is a diagram of a device 10*a* with the matrix 100 in the insert 406, in accordance with an example embodiment. In an example embodiment, insert 406*b* is substituted for insert 406 in this device 10*a*. In an example embodiment, the insert 406 is insertable into a distal (downstream) end of the heating section 30 of the device 10*a*. The insert 406 may, for instance, be friction-fitted within the end of the heating section 30. In an example embodiment, the insert 406 extends, at least partially, from the distal end of the heating section 30, such that the non-consumable filter 410 remains exposed and extends from the heating section 30 once the insert 406 is fully inserted into the heating section 30. In this embodiment, the non-consumable filter 410 may act as a mouthpiece for the device 10*a*. As stated above, the insert 406 may be disposable, whereas the heating section 30 need not be disposable.

Example Methods According to Some Example Embodiments

Figure 6:
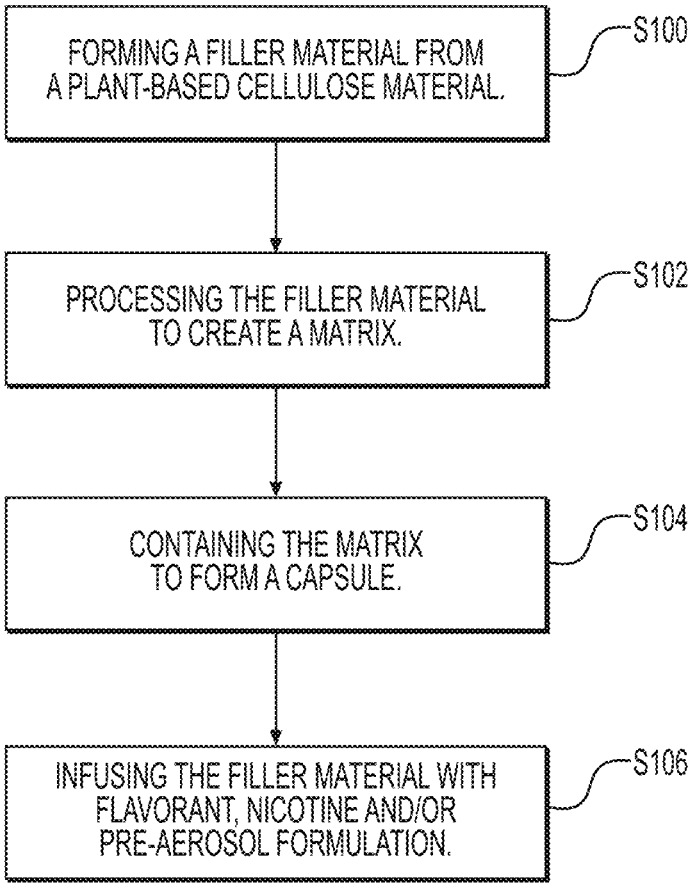
FIG. 6 is a flow chart of a method of making the matrix, in accordance with an example embodiment.

FIG. 6 is a flow chart of a method of making the matrix 100, in accordance with an example embodiment. In step S100, the filler material 105 is formed from a plant-based cellulose material. As described above, this plant-based cellulose material can either be a non-tobacco cellulose material or a tobacco cellulose. In step S102, the filler material 105 is processed to create the matrix 100. In an example embodiment, this is accomplished by shredding the filler material 105 to form the strands 102 of the filler material 105, where the strands 102 are then combined and/or compressed to form the matrix 100 (as described above). In another example embodiment, either in lieu of forming the strands 102, or in addition to forming the strands 102, portions or sheets of the filler material 105 are processed by folding, bunching or otherwise combining and/or compressing the filler material 105 to form the matrix 100. In any of these embodiments, the filler material 105 (or the strands 102 of the filler material 105) is also be perforated, at some point in the processing of the filler material 105, to increase the interstitial spaces 101 within the matrix 100.

In step S104, the matrix 100 is contained (e.g., bound together) to form the capsule 104. As described above, this may be accomplished by holding the matrix 100 together using the containing structure 103. In an example embodiment, the containing structure 103 is made from a metal, metal alloy, polymer, plastic, resin, mesh, cellulose, plant-based cellulose, fabric, cotton, fibers, threads, other textiles, pulp, paper, tipping paper, other suitable materials capable of containing the matrix 100, or combinations, or sub-combinations, of these materials. In an example embodiment, the containing structure 103 is made from the filler material 105. In an example embodiment, the matrix 100 is included in the containing structure 103 of the insert 406/406*b*, where these same recited method steps apply to the insert 406/406*b*. In an example embodiment, the containing structure 103 is wrapped in a longitudinal direction around the contained matrix 100 without covering upstream and downstream ends of the matrix 100.

In step S106, the filler material 105 is infused with the consumable substance that includes the flavorant, nicotine and/or ingredients of a pre-aerosol formulation. In an example embodiment, the infusing of the consumable substance occurs as the filler material 105 is being formed, or after the filler material 105 is formed (as described above). In another example embodiment, the infusing of the consumable substance occurs as the filler material 105 is being processed into the matrix 100, or after the matrix 100 is formed (as described above).

Figure 7:
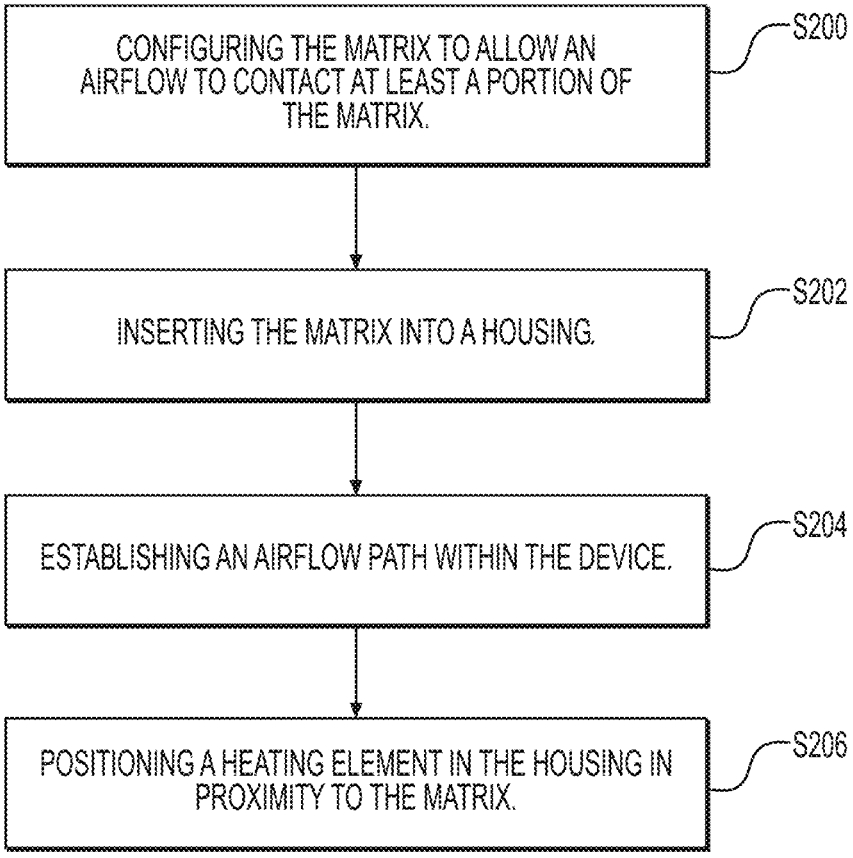
FIG. 7 is a flow chart of a method of making a device, in accordance with an example embodiment.

FIG. 7 is a flow chart of a method of making the device 10, in accordance with an example embodiment. In step S200, the matrix 100 allows an airflow to contact at least a portion of the matrix 100. As described above, this may be accomplished by providing openings in the containing structure 103, with an inlet and outlet opening to allow the airflow to pass through at least a portion of the matrix 100. In another example embodiment, the containing structure 103 is porous, such that the airflow is free to penetrate the containing structure 103 and flow across, or flow through, at least a portion of the matrix 100. In another example embodiment, or in addition to the other embodiments, at least a portion of the containing structure 103 exposes a portion of the matrix 100 to open air, thereby allowing the airflow to contact and/or pass across at least a surface of the matrix 100. In an example embodiment, this same method step applies to the matrix 100 within the insert 406/406*b*, where the matrix 100 allows airflow to contact (e.g., flow through) at least a portion of the matrix 100 for use in the device 10*a*.

In step S202, the matrix 100 is inserted into the housing 30*a* of the device 10. In step S204, an airflow path is established within the device 10. This may be accomplished by adding an air inlet 116 and a mouthpiece 112 to the device 10. In an example embodiment, the air inlet 116 and mouthpiece 112 are on either side of the matrix 100, such that the airflow path is forced to pass by, pass across, or pass through at least a portion of the matrix 100. In an example embodiment, this same method step applies to the insert 406/406*b*, where the insert 406/406*b* is inserted into the housing 30*a* of the heating section 30 of the device 10*a*—though in this embodiment, the airflow path may be between the air inlet 116 and the non-consumable filter 410 (as the mouthpiece 112 may not be included in the device 10*a*).

In step S206, the heating element 110 is positioned in the housing 30*a* in proximity (a heating proximity) to the matrix 100 and/or the containing structure 103 holding the matrix 100. This may include positioning the heating element 110 to be near or in contact with the matrix 100 and/or the containing structure 103, or this may include inserting at least a portion of the heating element 110 within the matrix 100 and/or the containing structure 103.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A method, comprising:

providing a filler material that is water insoluble, the providing provides the filler material with more than 98% alpha-cellulose, 0.01% to less than 2% ash and a remainder hemicellulose;

infusing at least one first consumable within the filler material; and inserting a matrix within at least one first containing structure to form a capsule, the matrix including the filler material.

2. The method of claim 1, further comprising:

shredding strands of the filler material prior to the inserting, the shredded strands defining interstices within the matrix.

3. The method of claim 2, wherein the infusing infuses the at least one first consumable which includes at least one of nicotine, at least one first flavorant, at least one first pre-aerosol formulation, or combinations thereof.

4. The method of claim 1, wherein the inserting inserts the matrix so that the at least one first containing structure contacts at least side surfaces of the matrix.

5. The method of claim 1, wherein the providing provides the filler material to include a non-tobacco material that does not include material from tobacco.

6. The method of claim 1, wherein the providing provides the filler material to include tobacco.

7. The method of claim 1, further comprising:

defining an airflow passage within a chamber of at least one first section;

first configuring the capsule to be in selective communication with the chamber; and second configuring a heater in the chamber to be within a heating proximity of the matrix when the capsule is in communication with the chamber.

8. The method of claim 7, wherein the first configuring configures the capsule to be selectively removable from an end of the at least one first section.

9. The method of claim 7, wherein the second configuring configures the heater to be in contact with at least one of the matrix or the at least one first containing structure when the capsule is in communication with the chamber.

10. The method of claim 7, further comprising:

first connecting a filter to the matrix to form the capsule.

11. The method of claim 10, wherein the first connecting connects the filter to the matrix so that the filter is spaced apart from the matrix within the capsule.

12. The method of claim 7, further comprising:

first connecting a filter to the matrix to form the capsule, wherein the first configuring configures the capsule to be selectively inserted into a distal end of the at least one first section to cause the filter to extend from the at least one first section.

13. The method of claim 7, further comprising:

electrically connecting a control system to the heater; and third configuring the control system to detect at least one first parameter and send an electrical current to the heater to at least partially vaporize the at least one first consumable based on the at least one first parameter, the at least one first parameter being a resistance of the heater, a temperature of the heater, a draw of air in the airflow passage, or a combination thereof.

14. The method of claim 1, wherein the inserting inserts the matrix so that the at least one first containing structure is wrapped around the matrix in a longitudinal direction, and at least one end of the matrix is not wrapped by the at least one first containing structure.

15. The method of claim 1, wherein the inserting inserts the matrix so that the at least one first containing structure is wrapped around the matrix in a longitudinal direction, and at least two ends of the matrix are not wrapped by the at least one first containing structure.

16. The method of claim 1, wherein the inserting inserts the matrix so that the at least one first containing structure is wrapped around the matrix.

17. The method of claim 1, further comprising:

first connecting a filter to the matrix to form the capsule.

18. The method of claim 17, wherein the first connecting connects the filter to the matrix so that the filter is spaced apart from the matrix within the capsule.

19. The method of claim 17, further comprising:

second connecting a flow restrictor to the filter and the matrix to form the capsule, the flow restrictor being between the filter and the matrix within the capsule.

20. The method of claim 17, further comprising:

second connecting a flow restrictor to the filter and the matrix to form the capsule, the flow restrictor being between the filter and the matrix within the capsule, the flow restrictor including an internal void space that separates the flow restrictor from the filter and the matrix.

* * * * *